US009742129B2

(12) United States Patent
Jenkin et al.

(10) Patent No.: US 9,742,129 B2
(45) Date of Patent: Aug. 22, 2017

(54) PIN FOR A SUBSEA CONNECTOR

(71) Applicant: Siemens Aktiengesellschaft, Munich (DE)

(72) Inventors: Kieran Jenkin, Millom (GB); Trevor Jones, Kendal (GB); Christopher Plant, Lancaster (GB)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 15/201,685

(22) Filed: Jul. 5, 2016

(65) Prior Publication Data

US 2017/0018892 A1 Jan. 19, 2017

(30) Foreign Application Priority Data

Jul. 15, 2015 (EP) ..... 15176843

(51) Int. Cl.

| | |
|---|---|
| ***H01R 13/53*** | (2006.01) |
| ***H01R 24/38*** | (2011.01) |
| ***H01R 13/523*** | (2006.01) |
| ***H01R 43/16*** | (2006.01) |
| ***H01R 13/52*** | (2006.01) |
| *H01R 13/533* | (2006.01) |
| *H01R 103/00* | (2006.01) |

(52) U.S. Cl.

CPC ..... *H01R 24/38* (2013.01); *H01R 13/521* (2013.01); *H01R 13/523* (2013.01); *H01R 43/16* (2013.01); *H01R 13/53* (2013.01); *H01R 13/533* (2013.01); *H01R 2103/00* (2013.01)

(58) Field of Classification Search

CPC ..... H01R 43/02; H01R 43/16; H01R 43/26; H01R 24/28; Y10T 29/49204; Y10T 29/49208; Y10T 29/49224

See application file for complete search history.

(56) References Cited

U.S. PATENT DOCUMENTS

| | | | | |
|---|---|---|---|---|
| 3,829,800 | A * | 8/1974 | Spinner | H01R 24/40 174/75 C |
| 4,142,770 | A * | 3/1979 | Butler, Jr. | H01R 13/523 439/140 |
| 4,865,359 | A * | 9/1989 | Roberts | F16L 1/202 285/369 |
| 6,036,501 | A * | 3/2000 | Wojewnik | B60R 16/0207 439/34 |
| 7,794,254 | B2 | 9/2010 | Marklove et al. | |
| 2003/0006787 | A1 * | 1/2003 | Kazama | G01R 1/06716 324/755.05 |
| 2004/0149471 | A1 * | 8/2004 | Hall | E21B 17/003 174/21 R |

(Continued)

FOREIGN PATENT DOCUMENTS

| | | |
|---|---|---|
| EP | 2811585 A1 | 12/2014 |
| EP | 2854247 A1 | 4/2015 |

*Primary Examiner* — Briggitte R Hammond

(74) *Attorney, Agent, or Firm* — Beusse Wolter Sanks & Maire

(57) ABSTRACT

A pin for a subsea connector having an electrical conductor, an insulating sleeve around the conductor and a conductive layer provided on a portion of the outer surface of the insulating sleeve. The insulating sleeve has a recess that extends in an axial direction over a portion of the insulating sleeve. The conductive layer is provided in the recess.

16 Claims, 4 Drawing Sheets

(56) References Cited

U.S. PATENT DOCUMENTS

| | | | | |
|---|---|---|---|---|
| 2005/0206037 | A1* | 9/2005 | Sufka | B29C 45/1671 264/271.1 |
| 2007/0037443 | A1* | 2/2007 | Wells | H01R 9/031 439/578 |
| 2008/0020611 | A1 | 1/2008 | Marklove et al. | |
| 2010/0244653 | A1* | 9/2010 | Schuck | H01J 5/50 313/318.12 |
| 2015/0090473 | A1* | 4/2015 | Burrow | H02G 15/10 174/105 R |

* cited by examiner

PIN FOR A SUBSEA CONNECTOR

CROSS REFERENCE TO RELATED APPLICATIONS

This application claims the benefit of European Application No. EP15176843 filed 15 Jul. 2015, incorporated by reference herein in its entirety.

FIELD OF THE INVENTION

The present invention relates to a pin for a subsea connector, to a connector part of a subsea wet-mateable connector, and to a method of manufacturing a pin of a subsea connector.

BACKGROUND

Subsea electrical connectors for use underwater are known, and are for example described in the document GB 2 192 316 A. A first connector part of the subsea electrical connector has at least one pin projecting from a support which is inserted into a housing and fixed in place by a retainer ring. The pin has an axially extending conductive core, for example a copper core, which is surrounded by an insulating sleeve which is arranged to expose an area of the conductive core at or near the tip of the pin for making electrical contact with a contact socket in the second connector part of the subsea electrical connector.

In the de-mated condition of the first and second connector parts, the pin may be exposed to the external environment and thus for example to seawater when deployed subsea. The insulating sleeve is intended to insulate the conductive core of the pin from exposure to the external environment and to provide electrical insulation. In the mated condition of the first and second connector parts, a portion of the pin and thus the insulating sleeve can still be exposed to surrounding seawater. Since such electrical subsea connectors can have a lifetime of more than 25 years, the insulation of the conductive core can experience long term subsea exposure. Electrophoresis may lead to an intrusion of seawater into the insulation. Furthermore, when such subsea connector is used for high voltage applications, high electrical stresses can occur in proximity to the pin of the connector, which can lead to a degradation of the material exposed to such high electrical field stresses, and may finally lead to a failure of such material, for example to the failure of a seal.

To overcome these difficulties, it is proposed in the patent U.S. Pat. No. 7,794,254 B2 to make use of a metal or metalized coating formed on the outer surface of an insulating sleeve. The metal or metalized coating can suppress penetration of water into the insulating sleeve and further can reduce localized condensing of equipotential electric field lines whereby electrical stresses can be reduced.

Furthermore, the document with the application number PCT/EP2014/065278 discloses the use of a ceramic coating on a component of a subsea connector to improve the corrosion resistance.

In certain configurations of wet-mateable connectors, it is desirable to provide a seal towards the connector pin when the connector parts are mated. The coating of the pin may require an adaptation of such seal to accommodate the coating, which makes the connector design more difficult. Further, at the transition between the non-coated surface and the coated surface on the pin, sliding of the seal over the pin may be hampered and retaining of a liquid-tight seal during such sliding may be more difficult. At the transition between the non-coated surface and the coated surface on the pin, electrical stresses might furthermore be difficult to control. Also, it might be necessary to manufacture such coating with quite high precision, resulting in a complex manufacturing process.

It is desirable to improve the mating of subsea connectors, in particular in a subsea environment, and to make subsea connectors more reliable and extend their lifetime. In particular, it is desirable to avoid negative effects of electrical stresses. Also, it is desirable to facilitate the manufacturing of a subsea connector and to make it more cost efficient.

SUMMARY

Accordingly, there is a need to obviate at least some of the drawbacks mentioned above and to provide improvements to subsea connectors.

This need is met by the features of the independent claims. The dependent claims describe embodiments of the invention.

According to an embodiment of the present invention, a pin for a subsea connector is provided. The pin comprises a conductor, an insulating sleeve around the conductor, wherein the insulating sleeve has an outer surface, and a conductive layer provided on a portion of the outer surface of the insulating sleeve. The pin has a front end and a rear end and extends in an axial direction between the front end and the rear end. The insulating sleeve has a recess that extends in the axial direction over a portion of the insulating sleeve. The conductive layer is provided in the recess.

By providing the conductive layer in the recess, it becomes possible to provide the portion of the pin that has the conductive layer with substantially the same outer diameter as the remaining portions of the pin. In such configuration, sealing against the pin is facilitated. In particular, when such pin is inserted into an opening of another connector part, in which a seal is provided that seals against the pin, the seal does not need to make a transition from a smaller diameter uncoated portion of the pin to a larger diameter coated portion of the pin. Accordingly, construction of the seal of the second connector part is also facilitated, and sealing to the pin is improved. Furthermore, due to the almost constant outer diameter, wear of the seal during repeated mating cycles may be reduced, and the lifetime of the connector may thus be prolonged. Even further, by providing the layer in the recess, wear of the conductive layer itself, which may for example occur due to abrasion, may be reduced. By providing the conductive layer in the recess, control of the shape of the conductive layer may further more be improved. By controlling the shape of the conductive layer, it becomes possible to further reduce electrical stresses that may occur for example in proximity to a forward end of the conductive layer.

In an embodiment, the outer surface of the insulating sleeve that is located forward of the recess and the outer surface of the conductive layer in a forward portion of the conductive layer are substantially flush. In particular, in this area, the outer diameter of the insulating sleeve forward of the recess and the outer diameter of the conductive layer may be substantially the same. When a seal slides over the transition from the insulating sleeve to the conductive layer, it may thus not experience any step, but may smoothly slide over the transition, thus improving the sealing during mating of the connector parts and reducing wear and abrasion of both, the conductive layer and the seal.

In an embodiment, the conductive layer fills the recess. In particular, the area (or volume) in which the insulating sleeve is recessed from the outer diameter of the pin may be completely filled with the conductive layer. In some embodiments, the conductive layer may not extend outside the recess, it may be only located within the recess. In other embodiments, the conductive layer may extend over the recess, for example over the rearward end of the recess.

In an embodiment, the pin has a portion with a substantially constant outer diameter. The recess is in this portion. The layer may fill the recess so that the outer diameter of the pin is substantially constant over this portion. A pin with a substantially constant outer diameter that comprises both an insulation and a conductive outer layer may thus be achieved.

The recess may have a forward end, and the conductive layer may be a ground layer that is configured to be earth during operation of the pin, i.e. when the pin is used to conduct electric power. The forward end of the recess may be shaped so as to control the electric field profile of the pin during operation. In other words, the forward end of the recess may be shaped so as to obtain a predefined distribution of the electric field. As an example, the forward end may be shaped so as to avoid areas with very dense equipotential field lines, i.e. areas having a high electric field gradient. By shaping the forward end of the recess in a controlled way, a graduated "exit" of the electric field through the insulation may thus be achieved. This is particular beneficial in high voltage (HV) applications of the pin.

It should be clear that the field generated during operation of the pin may also comprise magnetic components and may thus be an electromagnetic field, so the term electric may be substituted by the term electromagnetic. For the purpose of a concise presentation, the description given herein used the term 'electric field'.

In an embodiment, at the forward end of the recess, the depth of the recess may be gradually reduced. The forward end of the recess may for example be rounded. Accordingly, the conductive layer will have the same rounding. By providing a rounding and avoiding sharp edges, high gradients of the electric field may be prevented.

In an example, the forward end of the recess may be rounded with a radius that is larger than the depth of the recess. A smooth transition may thus be achieved. In particular, the radius end point may be located outside and above the recess. The angle between the outer surface of the conductive layer and the surface of the recess at the forward end of the recess may in particular be equal or smaller than 90°, it may be an acute angle.

The conductive layer may have a thickness of smaller than about 500 μm, advantageously smaller than about 300 μm. As an example, the layer may have a thickness in a range of between about 100 μm and about 800 μm.

The axial extension of the recess may be smaller than 60% of the axial extension of the insulating sleeve, it may be between about 10% and about 50%.

In an embodiment, the pin is a connector pin of a first connector part of a subsea connector. The pin has a sealed portion that is sealed inside a second connector part of the subsea connector when the subsea connector is a mated state. The recess and the conductive layer may extend in an axial direction into the sealed portion of the pin. Accordingly, in such configuration, the seal slides over the transition from the insulation sleeve to the conductive layer, thus benefitting from the conductive layer being provided in the recess. Furthermore, the conductive layer ends in a sealed portion when the subsea connector is in the mated state, so that the forward end of the conductive layer is not exposed to seawater. Electrical stresses may thus effectively be confined to within the subsea connector. Furthermore, since the seals moves over the conductive layer, which may be earthed during operation, the seal may be screened from electrical stresses.

In some embodiments, the pin may have an exposed portion that is exposed to the subsea environment when the subsea connector is in a mated state. The recess and the conductive layer may at least extend from the exposed portion into the sealed portion. Advantageously, in such configurations, the conductive layer extends over the whole exposed portion. In other embodiments, a protection mechanism may be provided that protects the pin from sea water when the connector is in the un-mated state, so that the pin may not have such exposed portion.

Advantageously, the conductive layer is electrically isolated from the conductor of the pin. Accordingly, the conductive layer can be earthed to provide effective stress control.

The recess may be provided circumferentially around the axial direction. In particular, the recess may be circumferentially continuous. The recess is advantageously only provided at the surface of the insulating sleeve so that good electrical isolation of the conductor is ensured. As an example, the depth of the recess may be smaller than 25% of the thickness of the insulating sleeve, (i.e. the material width of the insulating sleeve between the conductor and the outer surface of the sleeve), and advantageously, it may be smaller than 10%, more advantageously smaller than 5% of the thickness of the sleeve.

The recess may have a larger axial extension than its depth.

The insulating sleeve may be made of a polymer material. Advantageously, the insulating sleeve is made of Polyetheretherketone (PEEK).

The conductive layer may be made out of a metal or alloy, a conductive ceramic, a conductive polymer material or the like. Advantageously, the conductive layer is made out of metal alloy, e.g. have a composition similar to that of stainless steel. Advantageously, the material is a corrosion resistant material selected according to the Norsok Standard M-001. It may be a Ti based alloy.

The rear end of the pin may be the end of the pin at which the pin is supported by a support. The pin may thus project forward from the support. The pin may be the pin of a first part of the subsea connector, and the front end of the pin may be the end of the pin that enters a second part of the subsea connector during mating. 'Forward' refers to a direction towards the front end, whereas 'rearward' refers to a direction towards the rear end and thus towards the support of the pin.

The pin may be configured for providing a connection (in particular an electrical connection) to a respective connecting element, such as a socket contact in a second part of the subsea connector. The pin may be configured for insertion (with its front end) into a body of such second connector part and to be sealed at least at a front portion of the pin in such body.

According further embodiment of the invention, a connector part of a subsea wet-mateable connector is provided, wherein the connector part is configured to engage a complementary second connector part of the subsea wet-mateable connector. The connector part may thus be termed first connector part. The connector part comprises a support and a pin projecting forward from the support. The pin can have any of the above outlined configurations. The recess and the conductive layer are provided adjacent to and forward of the support. As with such connector, a pin of almost constant outer diameter may be achieved, the manufacturing of the connector part and the second connector part may be facilitated, and the robustness and lifetime of the connector parts may be improved. Furthermore, the above outlined advantages may be achieved.

It should be clear that the pin does not need have a constant outer diameter over its whole length; as an example, the rear end of the pin may have an increased diameter, for example for improving mechanical stability or the like. Also, the conductor provided inside the pin may have a varying diameter. For accommodating a larger rear end diameter of the conductor, the insulating sleeve and the pin may have a corresponding increased outer diameter.

The pin may be configured to enter an opening in the second connector part in sealing engagement with a circumferential seal provided in the opening. The seal may seal against the outer surface of the pin during the mating of the connector part with the second connector part. The recess and the conductive layer may extend forward to a position located such that when the connector part and the second connector part are mated, part of the recess and the conductive layer extend into or through the seal.

The connector part may furthermore comprise a seal that seals between the support and the pin. Such seal may be in contact with the outer surface of the pin, and it may in particular be in contact with the conductive layer of the pin. As an example, one or more O-ring seals may be provided between the pin's outer surface and the support.

According to a further embodiment of the invention, a connector comprising the connector part as described above and the second connector part is provided. The connector may for example be a high voltage subsea wet-mateable connector. In particular, the connector may be configured for operation at voltages in excess of 20,000 kV, advantageously in excess of 30,000 kV. Controlling the electrical stresses as outlined above is particularly beneficial for such high voltage ranges.

In other embodiments, the connector may be configured for operation at voltages in excess of 500 V, for example at 2 kV, 5 kV, 8 kV, 10 kV. At such lower voltages, the conductive layer isolates electrical stress to the insulation, which may allow the use of thinner insulation while retaining robustness of the connector. The connector may for example be configured to have an operating voltage selected from the range of about 1,000 V to about 75,000 V.

According to further embodiment of the present invention, a method of manufacturing a pin of a subsea connector is provided. The method comprises the step of providing a conductor and an insulating sleeve around the conductor, wherein the insulating sleeve has an outer surface. The pin has a front end and a rear end and extends in an axial direction between the front end and the rear end. The method further comprises the steps of providing a recess in the outer surface of the insulating sleeve, wherein the recess extends in an axial direction over a portion of the insulating sleeve; and providing a conductive layer in the recess.

By means of such method, advantages similar to the ones outlined further above with respect to embodiments of the pin may be achieved.

In an embodiment, the recess is machined into the insulating sleeve. By machining the recess, the shape of the recess may be controlled very precisely. In particular, the forward end of the recess and/or the rearward end of the recess may be shaped so as to control the electric field when the pin is in operation. Furthermore, the thickness of the conductive layer may be controlled quite precisely.

The term machining may in particular include methods that remove material, advantageously by mechanical means. As an example, machining may include one or a combination of grinding, abrading, milling, turning, sanding, planing, cutting, polishing or the like. In other embodiments, different methods of providing the recess in the insulating sleeve may be used.

In an embodiment, the step of machining the recess into the insulating sleeve is performed so as to provide a forward end of the recess with a gradually reducing depth (in forward direction, i.e. the recess is tapered towards the forward end of the pin). Advantageously, a rounded forward end is machined into the insulating sleeve. As outlined above, high field gradients and thus high electrical stresses may be prevented this way, and the way in which the field lines leave the insulator may be controlled.

In embodiments, different methods of providing the conductive layer may be used. As an example, metal plating, or metal coating, vacuum deposition or chemical deposition may be used. Examples of applying the conductive layer include evaporation, sputtering, cathodic arc vaporization, chemical vapor deposition or the like. In an embodiment, the conductive layer may be provided by thermal spraying. A relatively uniform conductive layer may thus be obtained, and a good binding between the conductive layer and the insulating sleeve may be achieved.

In some embodiments, the conductive layer is a single layer. In particular, the conductive layer may have substantially the same composition over the layer thickness (without considering certain effects that may occur at the boundaries of the conductive layer, such as diffusion effects or the like). The conductive layer may be applied in one process step, in particular in a process with substantially constant process parameters.

In some embodiments, the conductive layer may be composed of at least two layers, or may be applied by two or more subsequent process steps. The at least two layers may have substantially the same composition or may have a different composition. As an example, a first layer may be applied with a first set of process parameters and a second layer of the same or a different material may be applied with a second set of process parameters. Accordingly, the parameters of the process when applying the conductive layer may be adjusted. By providing the conductive layer as a layered structure of layers with different composition, properties of the conductive layer may be improved, such as adhesion to the insulating sleeve and corrosion resistance.

In an embodiment, after providing the conductive layer, the method may further comprise the step of machining the pin to substantially the same outer diameter over an axial portion of the pin that comprises at least a forward portion of the recess and of the conductive layer. Advantageously, the axial portion that is machined comprises the whole axial portion of the pin in which the recess and the conductive layer are provided.

Machining the pin to substantially the same outer diameter may for example be performed by a method that removes material, for example by one or a combination of grinding, abrading, milling, turning, sanding, planing, cutting, polishing or the like.

By machining the outer surface of the pin after applying the conductive layer, a relatively uniform outer diameter over the desired length of the pin can be achieved. Furthermore, since the portion of the pin can be machined to the same outer diameter, the machining operation as well as subsequent surface treatments are facilitated. Also, when applying the conductive layer, no masking needs to be provided, or the masking does not need to be precise, since any excess material of the conductive layer will be removed in the machining step. Accordingly, masking and thus manufacturing of the conductive layer is facilitated.

By means of embodiments of the method, a high degree of control over the uniformity, the thickness and the surface finish of the pin and in particular of the conductive layer may be achieved. Furthermore, by means of such method, an insulating sleeve with a conductive layer having a superior differential thermal expansion tolerance may be obtained. Even further, by providing the machining step and simplified post machining operations, an improved edge quality may be achieved that reduces defect initiators.

Furthermore, embodiments of the pin and the method may allow coated components to be used in a sealed penetration environment, where the seal slides over the coated component. Examples include wet-mateable connectors.

In an embodiment of the method, the method may be performed so as to obtain any of the above outlined pins or connector parts. Furthermore, steps that are described with respect to the pin, the connector parts or the subsea connector may form part of embodiments of the method.

It is to be understood that the features mentioned above and those yet to be explained below can be used not only in the respective combinations indicated, but also in other combinations or in isolation, without leaving the scope of the present invention.

BRIEF DESCRIPTION OF THE DRAWINGS

The forgoing and other features and advantages of the invention will become further apparent from the following detailed description read in conjunction with the accompanying drawings. In the drawings, like reference numerals refer to like elements.

DETAILED DESCRIPTION

Figure 1:
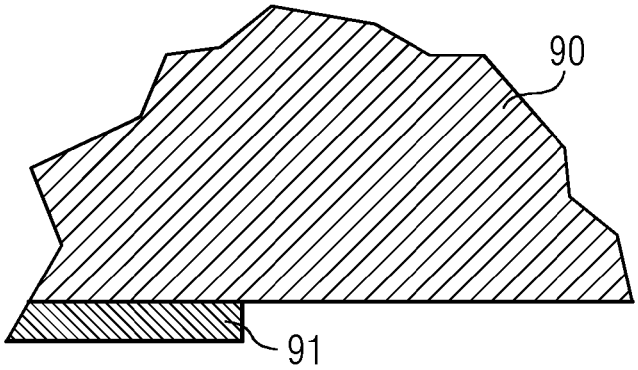
FIG 1 PRIOR ART
FIG. 1 is a schematic drawing showing a sectional view of a component to which a layer is applied.

In the following, embodiments illustrated in the accompanying drawings are described in more detail. It is to be understood that the following description of the embodiments is given only for the purpose of illustration is not to be taken in a limiting sense. It should be noted that the drawings are to be regarded as being schematic representations only, and elements in the drawings are not necessarily to scale with each other. Rather, the representation of the various elements is chosen such that their function and general purpose become apparent to a person skilled in the art.

FIG. 1 schematically illustrates a coating according to the prior art. A piece of material 90 is provided with a coating 91. As can be seen, the coating 91 forms a step on the surface of the substrate 90. Accordingly, in applications where a seal slides over the surface of the substrate 90, such step can hinder the travel of the seal on the surface of the substrate 90. Furthermore, it is clear that such seal must be capable of accommodating different diameters, it may need to be capable of sealing against the surface of the substrate 90 and against the coating 91. This may result in a reduced sealing efficiency and in a more complex configuration of the seal. If the thickness of the coating 91 exceeds a certain size, it might not even be possible to provide sufficient sealing with a seal that needs to slide over the step. Furthermore, the shape of the forward end of the coating 91 is generally defined by the masking and cannot be changed. Accordingly, relatively high electrical stresses due to electric field gradients may occur at the forward end of such coating.

Figure 2:
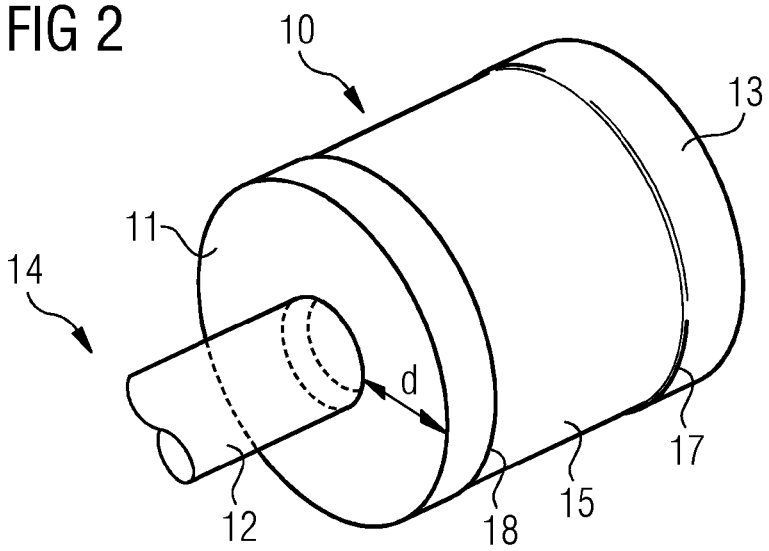
FIG. 2 is a schematic drawing showing a perspective view of a pin according to an embodiment.

FIG. 2 illustrates a pin 10 according to an embodiment of the invention. The pin 10 includes a conductor 12 that is surrounded by the insulating sleeve 11. The pin 10 extends along an axial direction from a front end 13 to a rear end 14. The insulating sleeve 11 may only cover a part of the conductor 12, the conductor 12 may for example protrude from a forward end of the insulating sleeve 11 for being connected to a forward contact portion (e.g., the contact portion 21 in FIG. 7), and/or it may protrude from a reward end of the insulating sleeve 11 for being connected to a further conductor, for example another pin or the conductor of a cable, for example by crimping. It should further be clear, that the insulating sleeve 11 is only illustrated schematically in FIG. 2 to highlight features of the present embodiment, and that the shape of the insulating sleeve 11 may be different in different applications, as for example shown in FIG. 7.

In the insulating sleeve 11, a recess 15 is provided. The recess 15 has a forward end 17 and a rearward end 18. It should be clear that in some configurations, there may not be provided a rearward end 18 and the recess 15 may extend all the way to the rearward end of the insulating sleeve 11.

The pin 10 may for example be the pin of a subsea wet-mateable electrical connector. In operation, the voltage, in particular an AC-voltage, may be applied to the electrical conductor 12. The insulating sleeve 11 provides electrical insulation for the conductor 12. In order to provide good electrical insulation, the insulating sleeve 11 has a thickness d, which is the difference between the outer diameter and the inner diameter of the insulating sleeve 11.

The insulating sleeve 11 may be a pre-manufactured component having a through bore into which the conductor 12 is inserted. In other embodiments, the insulating sleeve 11 may be a component that is molded around the conductor 12. Other configurations are certainly conceivable.

As can be seen in FIG. 2, the depth of the recess is only a fraction of the thickness of the insulating sleeve 11. This is illustrated in more detail in FIG. 3 which shows a cross section through a portion of the insulating sleeve 11 which includes the forward end 17 of the recess 15. The recess has a depth r. The depth r is significantly smaller than the thickness d, it may for example the smaller than 5%, or even smaller than 1% of the thickness d.

As an example, the thickness d may be between about 5 mm and about 50 mm, whereas the depth r may be between about 0.001 mm and about 1 mm. Advantageously, the depth r is between about 100 μm and about 800 μm.

Figure 3:
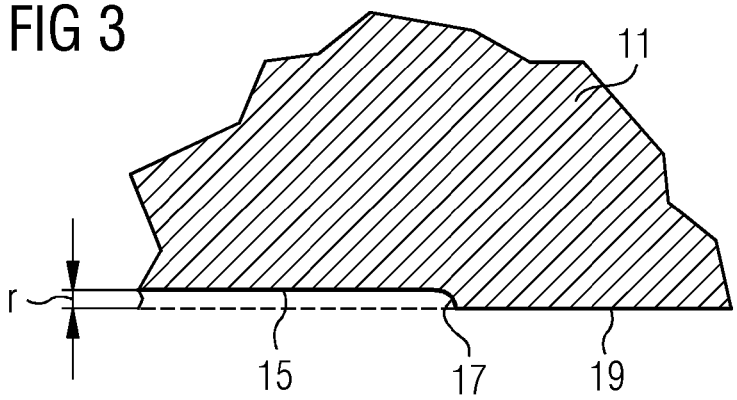
FIG. 3 is a schematic drawing showing a sectional view of an insulating sleeve with a recess according to an embodiment.

As can be seen in FIG. 3, the forward end 17 of the recess 15 can be provided with a desired shape. In the example of FIG. 3, the forward end is rounded to provide a smooth transition from the recess 15 to the non-recessed surface of the insulating sleeve 11.

Figure 4:
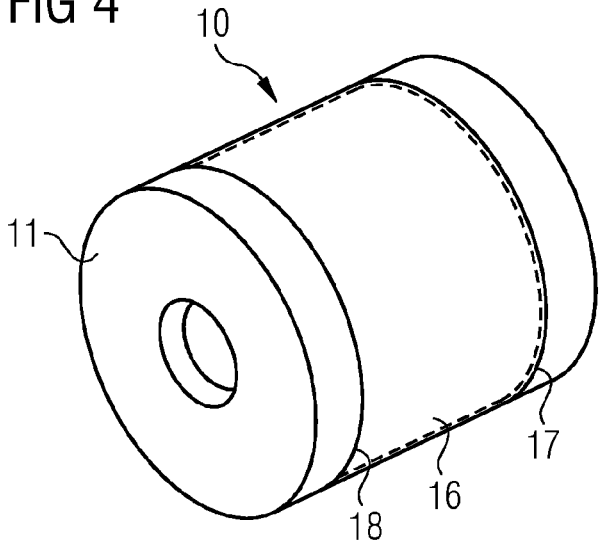
FIG. 4 is a schematic drawing showing a perspective view of a pin according to an embodiment.
Figure 5:
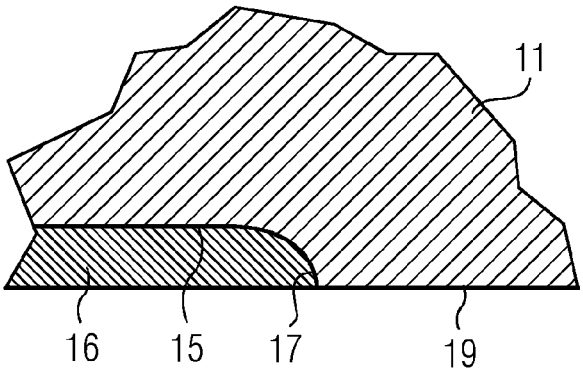
FIG. 5 is a schematic drawing showing a sectional view of an insulating sleeve including a recess and a conductive layer according to an embodiment.
Figure 6:
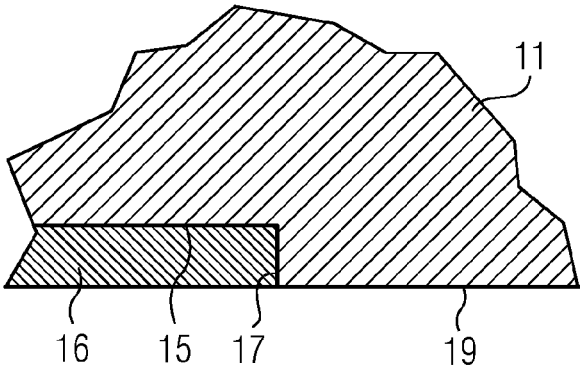
FIG. 6 is a schematic drawing showing a sectional view of an insulating sleeve including a recess and a conductive layer according to an embodiment.

The pin 10 is furthermore provided with a conductive layer 16 that is illustrated in FIG. 4. Note that in FIG. 4, the conductor 12 is not shown but may certainly be present. The conductive layer 16 is provided in the recess 15. Most of the recess 15 is covered with the conductive layer 16. Advantageously, the conductive layer 16 completely fills the recess 15. As illustrated in FIGS. 5 and 6, the conductive layer 16 is advantageously flush with the outer surface 19 of the insulating sleeve 11 in a portion forward of the forward end 17. Similarly, the conductive layer 16 may also be flush with the outer surface 19 of the insulating sleeve 11 at the rear ward end 18 of the recess 15. In other embodiments, the conductive layer 16 may also extend over the outer surface 19 of the insulating sleeve 11 at the rear ward end 18 of the recess 15, for example for providing electrical contacting to earth/ground the conductive layer 16, although such contacting can certainly also occur if the conductive layer 16 is flush at the rearward end 18.

The outer surface of the insulating sleeve 11 is designated with reference numeral 19 in FIGS. 3, 5 and 6, it defines the outer perimeter of the pin forward of the recess 15 and then extends underneath the conductive layer 16.

As can be seen in FIGS. 5 and 6, by providing the conductive layer 16 in the recess 15, the outer surface of the pin 10 is in a forward portion of the pin defined by the outer surface 19 of the insulating sleeve 11 and is continued by the conductive layer 16, so that there is no step. Accordingly, a seal can slide along the outer surface 19 and onto the conductive layer 16 without the need to adapt to different diameters of the pin 10. The configuration of the seal can thus be simplified. Furthermore, there is no or only little abrasion to the conductive layer 16 upon repeated mating cycles, i.e. upon a repeated sliding of the seal over the conductive layer 16. Furthermore, a degradation of the seal by the repeated sliding over a step can be prevented in such configurations. In particular, with the described embodiments, it becomes possible to provide the pin 10 with an almost constant outer diameter in the portion over which the seal slides. Reliability and robustness of a connector employing such pin may thus be improved.

As outlined above, by providing the conductive layer in the recess 15, it becomes possible to adapt the shape of the conductive layer 16 at the forward end 17 to the desired application. The geometry of this so called "run-out" of the conductive layer 16 can be adjusted to improve the mechanical performance and the electrical performance of the conductive layer 16. With respect to mechanical performance, the geometry may be adapted so as to ensure good compatibility with respect to thermal expansion. As an example, it may be ensured that the mechanical hoop stress induced by thermal expansion does not exceed the tensile strength of the conductive layer 16. Good mechanical performance can for example be obtained with a geometry of the run-out of the conductive layer 16 as illustrated in FIG. 6.

With respect to electrical performance, the conductive layer 16 is generally earthed to provide shielding of the seal in the connected state of the subsea connector against the electromagnetic field generated by the electrical power that is transported by means of the conductor 12. Since the conductive layer 16 is earthed, the field is confined to within the electrical insulating sleeve 11. At the position at which the conductive layer 16 ends, the field will leave the insulation. By adjusting the geometry of the run-out of the conductive layer 16, a graduated exit of the field through the insulation may be achieved. This may for example be achieved by providing a rounded forward end 17 of the recess 15 and thus of the conductive layer 16. Such configuration avoids high electric field gradients and thus high electrical stresses.

Advantageously, the forward end of the recess 15 is shaped as illustrated in FIG. 5. The recess 15 has a rounded forward end 17. The angle at the run-out of the conductive layer 16 between the outer surface of the conductive layer 16 and the surface of the recess 15 is advantageously within a range of about 25 degrees to about 90 degrees, advantageously it is smaller than 90°. As an example, it may be about 60° as illustrated in FIG. 5.

By such configurations, wear resistance of the conductive layer 16 can be improved, and good mechanical properties of the conductive layer 16 over a wide thermal range can be achieved. Furthermore, by the design of the forward end 17 of the recess 15, the control of the electromagnetic field, in particular high voltage field generated by electrical power transported through the conductor 12, can be controlled.

Figure 7:
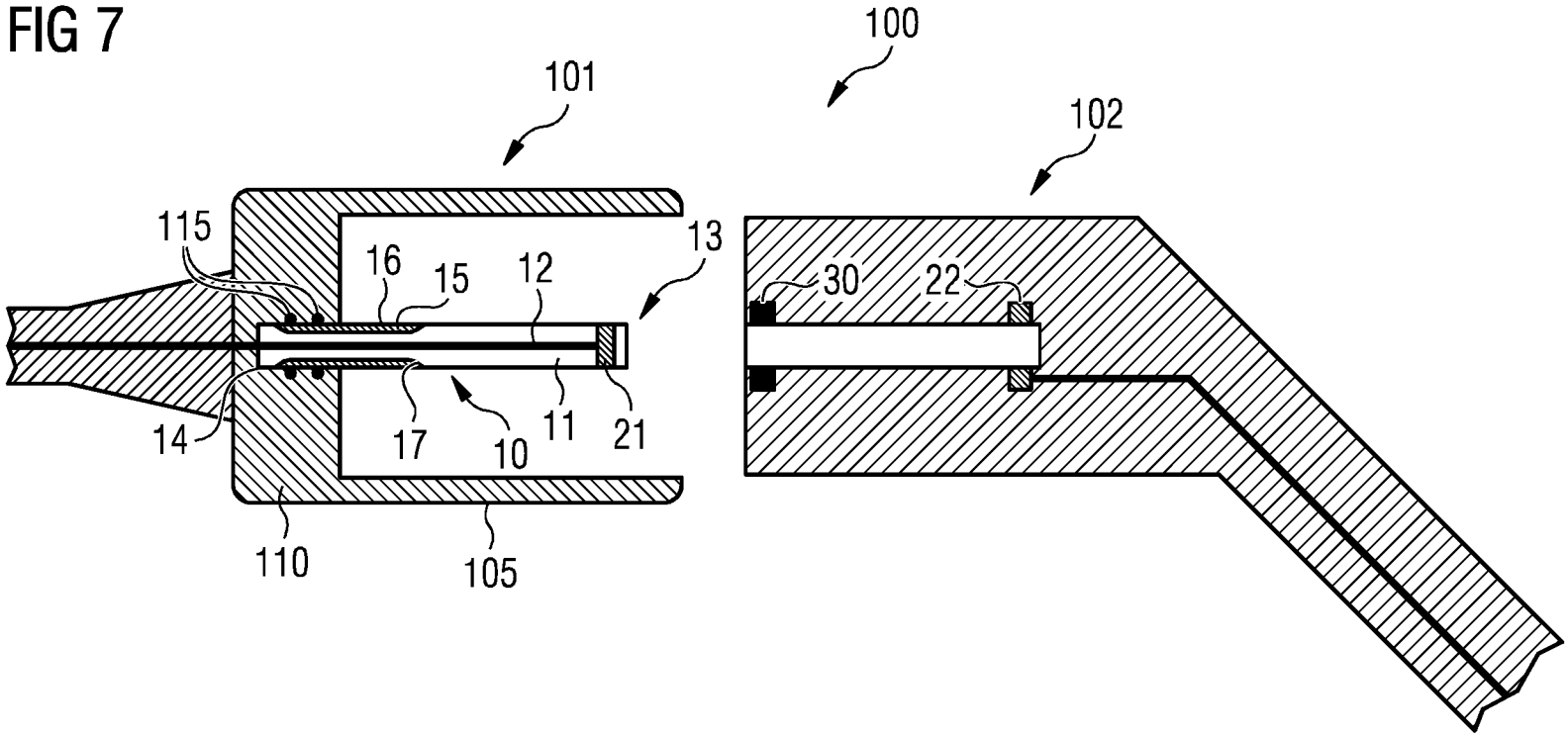
FIG. 7 is a schematic drawing showing a sectional side view of a subsea wet-mateable connector including a pin according to an embodiment of the invention.

FIG. 7 illustrates a subsea wet-mateable connector 100 having a first connector part 101 and a second connector 102 according to an embodiment of the invention. The first connector part 101 comprises a pin 10, and the pin 10 can have any of the configurations described above and illustrated in FIGS. 2 to 6. The first connector part 101 has a housing 105 with a support 110, in which the pin 10 is supported. It should be noted that the basic connector components are shown only very schematically, and that the subsea wet-mateable connector 100 can be configured in accordance with any previously known wet-mateable connector.

The conductor 12 extends through the conductive sleeve 11 of the pin 10 and is in electrical contact with the forward contact portion 21 of the pin 10. During the mating of the first and the second connector parts 101, 102, the pin 10 enters an opening in the second connector part 102. Upon completion of the mating procedure, the contact portion 21 of the pin 10 is in electrical contact with the socket contact 22 in the second connector part 102. Generally, a shuttle pin or a shuttle piston (not shown) will be provided inside the opening of the second connector part 102 to prevent exposure of the internal components of the second connector part 102 to the subsea environment.

Upon the pin 10 entering the opening in the second connector part 102, the seal 30 will slide over the outer surface of the pin 10 in sealing engagement therewith. Ingress of seawater into the second connector part 102 during the mating procedure and in the mated state will thus be prevented. Accordingly, during the mating, the seal 30 slides along the outer surface of pin 10 and eventually slides over the conductive layer 16 that is provided in the recess 15. As outlined above, since the outer surface of insulating sleeve 11 and the outer surface of the conductive layer 16 are substantially flush, i.e. there is no step, the above outlined advantages can be achieved.

In the fully mated state, the seal 30 is generally in contact with the outer surface of pin 10 in the region where the conductive layer 16 is provided. Accordingly, the seal 30 is effectively screened from the electrical stresses induced by the electrical field generated by the voltage applied to the electrical conductor 12. In some embodiments, a portion of the pin adjacent to the support 110 may be exposed to seawater in the mated state. The conductive layer 16 may in such configuration furthermore provide protection against the diffusion and permeation of seawater into the insulating sleeve 11. In other configurations, a further protection may be provided for the pin 10, such as a sliding carriage, so that the rear portion of the pin 10 is located within an oil filled volume or the like and is protected from surrounding seawater.

At the rear portion of the pin 10, the pin 10 may for example be sealed towards the support 110 by means of O-ring seals 115. The conductive layer 16 may be in electrical contact with the support 110 for providing a connection to ground, or a dedicated contact may be provided for grounding the conductive layer 16.

The second connector part 102 may comprise further seals that slide on the surface of the pin 10 during mating. These may similarly benefit from the advantages outlined above with respect to the embodiments described herein.

The recess 15 and the conductive layer 16 may extend only over a portion of the insulating sleeve 10. In particular, a predetermined spacing between the forward contact portion 21 and the grounded conductive layer 16 is maintained. Generally, the conductive layer 16 extends from a position adjacent to the support 110 to a position that is located forward of the support 110 and that is located on a sealed portion of the pin that is sealed inside the second connector part 102 by means of the seal 30 when the connector 100 is in the mated state. Good electrical screening can thus be ensured.

Figure 8:
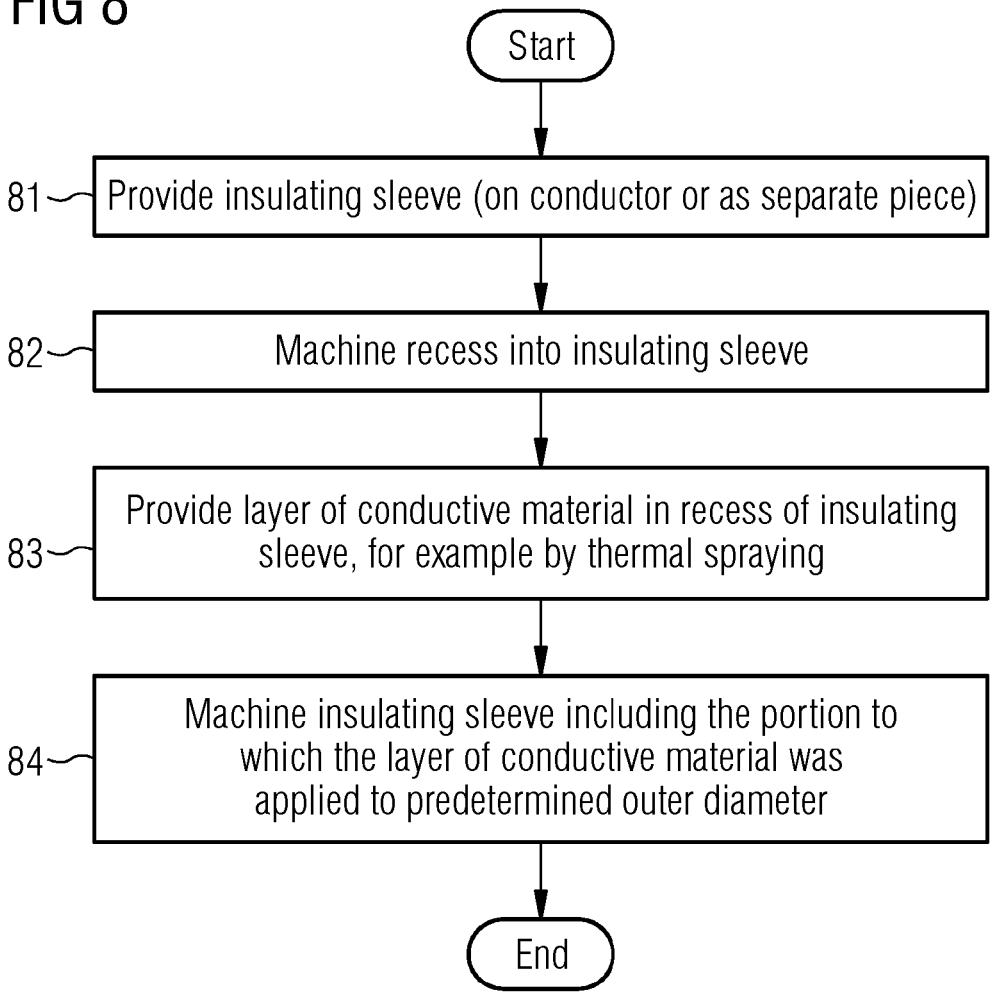
FIG. 8 is a flow diagram illustrating an embodiment of a method according to the invention.

FIG. 8 shows a flow diagram of a method of manufacturing a pin according to an embodiment of the invention. The method may be carried out so as to obtain the pin in any of the above outlined configurations. In a first step 81, the insolating sleeve 11 is provided, either on a conductor, for example molded around a conductor, or as a separate piece. In step 82, the recess 15 is machined into the insulating sleeve 11, as shown in FIG. 2. In step 83, a layer of conductive material is provided in the recess 15 of the insulating sleeve 11. The conductive material may be applied to the insulating sleeve by methods such as thermal spraying. It is noted that with the present method, it is not necessary to provide a very precise masking of the area that is to be covered by the conductive material. Masking of the area to be provided with conductive material is thus simplified. The layer of conductive material that is applied to the insulating sleeve 11 has a thickness sufficient to completely fill the recess 15.

In the next step 84, the insulating sleeve including the portion to which the layer of conductive material was applied is machined to a predetermined outer diameter. As an example, the whole insolating sleeve may be machined to a predetermined outer diameter, so that the outer diameter is constant over the whole axial extension of the insulating sleeve. In other embodiments, only a forward portion of the insulating sleeve including the forward end of the conductive layer may be machined to the desired outer diameter.

By such manufacturing method and by machining the insolating sleeve with the applied layer of conductive material to the desired outer diameter, a superior quality of the resulting conductive layer 16 can be obtained, thus reducing defect initiators. Furthermore, such method provides a high degree of control over uniformity, thickness and surface finish of both the insolating sleeve and the resulting conductive layer 16. Even further, by the machining step, it may be ensured that the conductive layer is flush with the remaining exposed outer surface of the insulating sleeve, in particular that no steps occur. Also, post machining operations are simplified due to the constant outer diameter of the insulating sleeve including the conductive layer 16. As can be seen, embodiments of the method provide an improved and simplified manufacturing of the pin.

While specific embodiments are disclosed herein, various changes and modifications can be made without departing from the scope of the invention. The present embodiments are to be considered in all respects as illustrative and non-restrictive, and all changes coming within the meaning and equivalency range of the appended claims are intended to be embraced wherein.

The invention claimed is:

1. A pin for a subsea connector, comprising:
an electrical conductor,
an insulating sleeve around the electrical conductor, wherein the insulating sleeve has an outer surface,
a conductive layer provided on a portion of the outer surface of the insulating sleeve,
wherein the pin has a front end and a rear end and extends in an axial direction between the front end and the rear end,
wherein the insulating sleeve has a recess that extends in the axial direction over the portion of the insulating sleeve, wherein the conductive layer is provided in the recess,
wherein the outer surface of the insulating sleeve and an outer surface of the conductive layer comprise a same diameter.

2. The pin according to claim 1,
wherein the conductive layer fills the recess.

3. The pin according to claim 1,
wherein the recess has a forward end, and wherein the conductive layer is a ground layer that is configured to be earthed during operation of the pin, wherein the forward end is shaped so as to control an electric field profile of the pin during operation.

4. The pin according to claim 1,
wherein at a forward end of the recess, a depth of the recess is gradually reduced.

5. The pin according to claim 4,
wherein the forward end of the recess is rounded with a radius that is larger than the depth of the recess.

6. The pin according to claim 5,
wherein a radius end point is located outside and above the recess.

7. The pin according to claim 1,
wherein the pin is a connector pin of a first connector part of a subsea connector;
wherein the pin has a sealed portion that is sealed inside a second connector part of the subsea connector when the subsea connector is in a mated state; and
wherein the recess and the conductive layer extend in the axial direction into the sealed portion.

8. A connector part of a subsea wet-mateable connector, wherein the connector part is configured to engage a complementary second connector part of the subsea wet-mateable connector, wherein the connector part comprises
a support;
a pin according to claim 1, the pin projecting forward from the support,
wherein said recess and said conductive layer are provided adjacent to and forward of the support.

9. A method of manufacturing a pin of a subsea connector, comprising:
providing an electrical conductor and an insulating sleeve around the electrical conductor, wherein the insulating sleeve has an outer surface, wherein the electrical conductor and the insulating sleeve comprise part of a pin that has a front end and a rear end and extends in an axial direction between the front end and the rear end, providing a recess in the outer surface of the insulating sleeve, wherein the recess extends in the axial direction over a portion of the insulating sleeve, providing a conductive layer in the recess, and wherein the outer surface of the insulating sleeve and an outer surface of the conductive layer are flush with each other.

10. The method according to claim 9, wherein providing the recess comprises machining the recess into the insulating sleeve.

11. The method according to claim 10, wherein machining the recess into the insulating sleeve is performed so as to provide a forward end of the recess with a gradually reducing depth.

12. The method according to claim 9, wherein the conductive layer is provided by thermal spraying.

13. The method according to claim 9, wherein after providing the conductive layer, the method further comprises:

machining the pin to a same outer diameter over an axial portion of the pin that comprises at least a forward portion of the recess and of the conductive layer.

14. The method of claim 13, wherein the axial portion of the pin comprises a whole axial portion in which the recess and the conductive layer are provided.

15. The pin according to claim 4, wherein the forward end of the recess is rounded.

16. The method according to claim 11, wherein the forward end of the recess is rounded.

* * * * *